United States Patent [19]

Doerffer et al.

[11] Patent Number: 4,822,311

[45] Date of Patent: Apr. 18, 1989

[54] FREE FALL SUBMERSIBLE LIFE SAVING DEVICE FOR OFFSHORE STRUCTURES

[75] Inventors: Jerzy W. Doerffer, Sopot; Lech Rowi ski, Woclawy; Andrzej Niepieklo, Gda sk; Ján Klopocki, Gda sk; Boguslaw Siwek, Gda sk, all of Poland

[73] Assignee: Politechnika Gdanska, Sdansk, Poland

[21] Appl. No.: 133,202

[22] Filed: Dec. 15, 1987

Related U.S. Application Data

[63] Continuation of Ser. No. 770,389, Aug. 28, 1985, abandoned.

[30] Foreign Application Priority Data

Sep. 5, 1984 [PL] Poland ..... 249475

[51] Int. Cl.[4] ..... B63B 23/28

[52] U.S. Cl. ..... 441/87; 114/365; 114/349

[58] Field of Search ..... 441/87, 7; 114/348, 114/349, 323, 324, 325, 336, 365, 366, 294, 210

[56] References Cited

U.S. PATENT DOCUMENTS

| | | | |
|---|---|---|---|
| 3,259,926 | 7/1966 | Otterman | 114/349 |
| 3,702,690 | 11/1972 | Higgins | 114/365 X |
| 4,297,757 | 11/1981 | Palemon Camu | 114/349 |
| 4,346,664 | 8/1982 | Enzian, Jr. | 114/349 |
| 4,365,579 | 12/1982 | Perez, Jr. | 114/365 X |
| 4,405,263 | 9/1983 | Hall | 114/294 X |
| 4,527,503 | 7/1985 | Connelly | 441/87 X |

FOREIGN PATENT DOCUMENTS

| | | | |
|---|---|---|---|
| 2423293 | 11/1975 | Fed. Rep. of Germany | 114/349 |
| 8302261 | 7/1983 | PCT Int'l Appl. | 114/365 |
| 459261 | 1/1937 | United Kingdom | 114/349 |
| 2148802 | 6/1985 | United Kingdom | 114/365 |

*Primary Examiner*—Sherman D. Basinger
*Assistant Examiner*—Paul E. Salmon
*Attorney, Agent, or Firm*—Ladas & Parry

[57] ABSTRACT

A free fall, submersible life saving device for an offshore structure has a spherical pressure shell in a casing. The upper part of the device has a lifting frame and at least one manhole closed with a cover and the lower part has ballast, an anchor, and a windlass 5 for the anchor rope having automatic control of the tension in the anchor rope. The device is launched by a catapult on the offshore structure for horizontal movement in free fall to the water surface, where it submerges and is anchored until resurfacing, by release of the anchor, for rescue.

16 Claims, 4 Drawing Sheets

FREE FALL SUBMERSIBLE LIFE SAVING DEVICE FOR OFFSHORE STRUCTURES

This is a continuation of co-pending application Ser. No. 770,389, filed on Aug. 28, 1985, abandoned.

BACKGROUND OF THE INVENTION

The subject of this invention is a free fall submersible life saving device, particularly for offshore structures working in extremely heavy weather conditions.

The life saving appliances generally used on board offshore structures, including ships, are life boats and pneumatic life rafts. From Whittaker Survival Systems Bulletins 21C - 483, 36/38C - 483, 50/54 LR-483 and 50/54C - 483, however, life saving capsules and corresponding launching gear are also known. The launching gear permits fast lowering of the capsule by means of steel cables and winches. The design of these capsules is similar to the design of a well-known, enclosed life boat. The capsule is made of glass reinforced plastic. Inside the capsule, which is of ellipsoidal shape, can be seated 14 to 54 survivors, depending on the version of the capsule. The survivors are placed on a single-tier bench along the sides, bow and stern of the capsule, secured by safety belts. The capsule is self propelled. It also is fitted with a water spray installation for maintaining a fire barrier and with sanitary and radiolocation installations. It contains all necessary provisions of oxygen and food.

From a paper "Offshore Evacuation", published in "Safety at Sea", another life boat, in this case of the Norwegian makers Harding A/S, is known. It can be dropped from a height of 30 m. The hull structure is made of steel. The life boat is placed on inclined rails and kept in position by hook with its bow pointing to the surface of the water. The bow is very slender to produce relatively low forces when the life boat is dropped into the water; after the hooks are released, the life boat accelerates rapidly so that it submerges under the water surface. After a few seconds, it emerges and sails away from the danger are using her own power. Airplane chairs are provided for the survivors. The back rests of these chairs point in the direction of the deceleration of the forces created by the life boat striking the water surface.

Evacuation of the survivors is facilitated by two-level platforms, each fitted on the level of entrance hatches to the boat. The survivors are secured to the chairs by special safety belts. Each boat can accommodate about 70 people. It is fitted with all the standard equipment, required by regulations and regional requirements, for propulsion, oxygen, food, sanitary arrangements, radiolocation, etc.

From Polish Patent No. 106757, there is known a device for underwater research, which contains a crew cabin made of glass-reinforced plastic. This cabin is distinguished by its construction. It is built of twelve pentagonal sandwich sections made of glass reinforced polyester or epoxy resin. Manholes and view ports are fitted in these pentagonal sections, which form a spherical structure capable of withstanding the outside water pressure. The edges of the pentagonal sections are made in the form of flanges pointing inwards. These flanges are glued together and the butts are reinforced additionally by laminate straps. Manhole and viewport openings are made in a manner similar to the sides of pentagonal sections.

The essential shortcomings of the above, as life-saving appliances, are the long times needed for getting them into readiness and lowering into the sea, as well as the production of high deceleration forces introduced by the free fall. They also strike the sea in close proximity to the offshore structure in danger. As the result of this, they are often damaged, and frequently destroyed when washed against the structure in heavy weather. Also, they do not isolate the survivors from external conditions, especially from the influence of waves. The impact of waves and wind upon the floating life saving appliance also causes drift, often for large distances from the place of casualty. As the result, search must be conducted over large areas, which decreases survival.

None of the above, as life-saving appliances, therefore, secures full safety, especially in extremely heavy weather conditions and in case of fire and gas. Casualty statistics show that many of these appliances could not be launched due to excessive heel of the offshore structure or that they were seriously damaged by striking against the structure or upon falling into the water. The problem of appliances releasing themselves without crew involvement and the time to evacuate the survivors therefore still remains open.

SUMMARY OF THE INVENTION

A free fall, submersible life saving device, particularly for offshore structures working in extreme weather conditions, has, according to the present invention, a spherical-capsule pressure shell. The capsule has, in the upper part, at least one manhole closed with a cover and, in the lower part, glands for electric cables, hydraulic piping and a windlass mechanical drive. The capsule is in an outer casing. The lower part of the casing has a windlass with automatic control of the force in an anchor rope thereon, ballast, and an anchor on the anchor rope. The ballast is detachably connected to the lower part of the casing by mechanical grips, and the anchor is releasably fastened to it by at least one holder and connected to the windlass by the anchor rope. The device is placed on a tilting-frame catapult fixed to the offshore structure. The tilting frame has a grating, i.e. deck, with a railing and a gangway to the deck of the offshore structure. In the lower part of the tilting frame is a pneumatic or pirotechnic launching jack fitted with a blocking arrangement.

Elastomeric pads are preferably placed between the spherical pressure shell and the outside casing shell. The elastomeric pads act as a suspension and shock absorber which allow relative movements of the spherical pressure shell of the capsule and outer casing shell. There are also elastic air or gas bags placed inside the outer casing shell structure. These bags are provided to give the whole device, even with full complement inside, additional buoyancy in excess of its weight, for example, in the case of anchor winch and ballast release failure. During a standby period, when the life saving device is suspended on an offshore structure, and during a launch period, these bags are folded to minimize the buoyance force and deceleration rate while penetrating the water surface.

Inside the pressure shell is accommodation for survivors in which the following items are placed: a hand drive (for windlass gearing as described below), electric batteries with necessary insulation and installation, a sanitary installation, a sewage tank, fresh water tanks, outer and inner rings of seats, and a maneuvering console equipped with a radiostation and underwater and wire telephones. Outside the cabin, i.e. pressure shell, is a transmitter of hydroacoustic signals for the underwater telephone, signalling buoy, radar reflector, position and flashable lights, and telescopic mast for radio antenna and radar reflector, as well as the windlass, anchor rope and anchor, and ballast, as already indicated.

The windlass with automatic control of the tension in the anchor rope has a rope drum connected with friction disc and hydraulic brakes through two pairs of gears with epicyclic teeth. One pair of the gears is fitted on the friction disc brake axis to move axially. The other pair is connected with the hand drive in the cabin by bevel gears and a clutch. The friction brake is fitted with a spring and an hydraulic depth corrector.

The holder connecting the anchor to the ballast is an hydraulic jack with a spring fastened to the ballast. At its lower part, it has a holder supporting a hook fitted to the anchor. The jack is provided with a special steering, i.e. control valve.

The life saving device has several advantages, the most important of which are:

the possibility of fast evacuation of crew from a sinking offshore structure by vertical free fall from the height of 30 m or parabolic fall by means of the catapult in order to secure maximum distance from the sinking structure;

the possibility of submerging and staying submerged with all survivors for at least 48 hours at a depth of about 50 m, where there is no influence of waves, wind and low temperatures, i.e. where there is independence from the weather conditions on the surface of the sea.

The weight of the life saving device with the ballast and the anchor, but without any person on board, exceeds the buoyancy force of the device when fully submerged. The volume of all elastic air bags is sufficient to give the device completely equipped with the ballast, the anchor and with full complement on board positive buoyancy.

The anchor keeps the device in a constant position in close proximity to the casualty, irrespective of underwater currents, which facilitates the rescue operations. Detaching the ballast and windlass with anchor from the device gives the possibility of surfacing and lifting it from the sea surface by a helicopter.

BRIEF DESCRIPTION OF THE DRAWING

The subject of this invention is shown by an example in the drawings.

DESCRIPTION OF THE EXAMPLE

Figure 1:
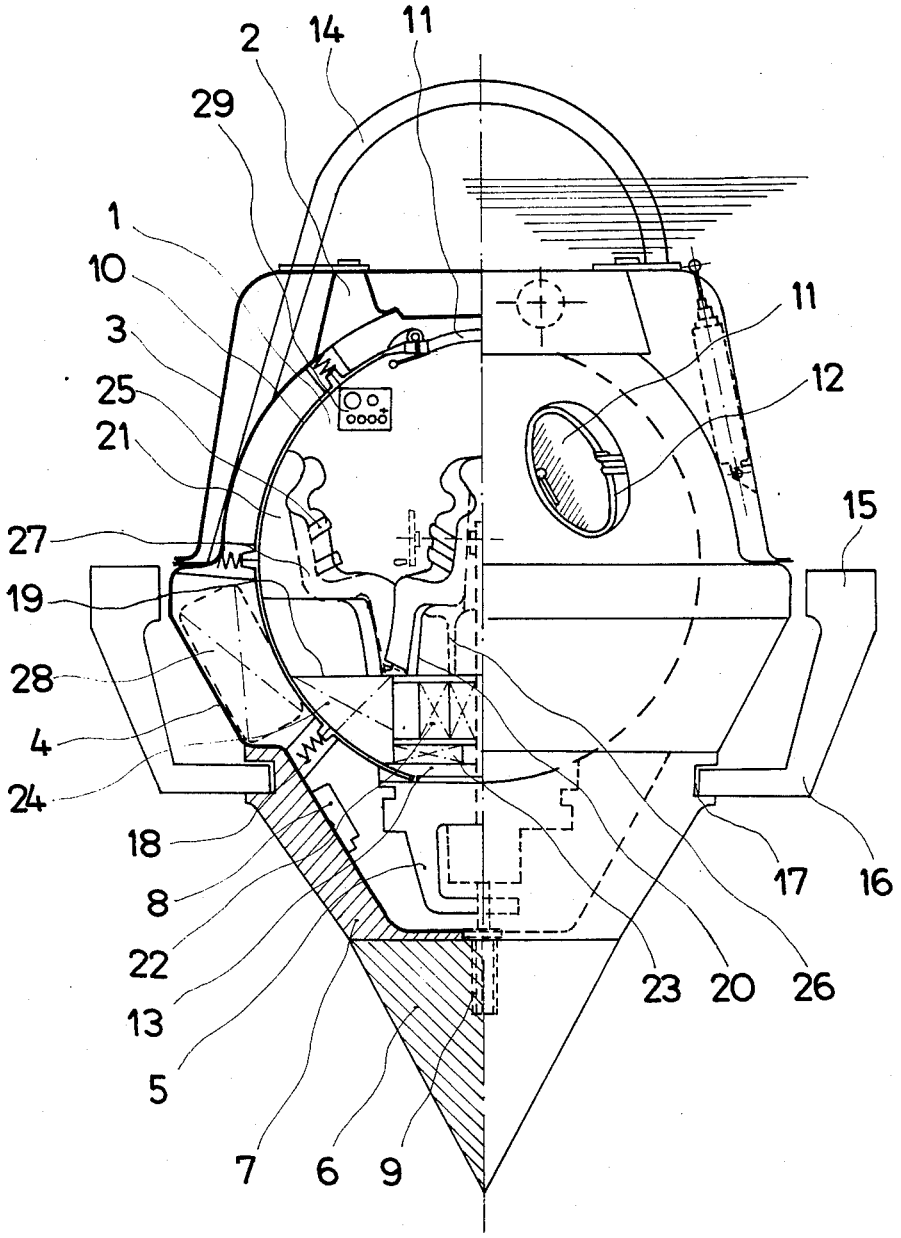
FIG. 1 shows the device in front elevation, half in section.

As shown in FIG. 1, the device has a spherical pressure shell 1, made of glass reinforced polyester resin, inside an external casing 2 having upper 3 and lower 4 parts. A windlass 5 for an anchor rope 38 connected to an anchor 6 and a ballast 7 are in the lower part 4 of the casing 2. The ballast 7 is detachably connected to the lower part 4 of the casing 2 by mechanical grips 8 and the anchor 6 is underneath the ballast 7 and detachably fastened to it by a holder 9.

The pressure shell 1 has twelve pentagonal sections 10 juxtaposed into a sphere. The parts 10 in the upper section of the pressure shell 1 have manholes 11 and manholes covers 12. In the lower section of the pressure shell, there are glands 13 for electric cables, hydraulic piping and a mechanical drive for the windlass 5.

The outside casing 2 is fitted with a lifting frame 14, rigidly fastened to the lower part 4 of the casing 2.

The device is placed on a catapult at 15 fastened to an offshore structure OS (FIG. 2), as later described. The catapult has a tilting frame 16 on which the device slidably rests by means of guiding slots 17 in the ballast 7.

Between the pressure-shell spherical capsule 1 and the outside casing 2, thirty elastic pads 18 (only one shown) are fitted about the shell 1 in places where its pentagonal sections 10 join.

Inside the spherical pressure shell 1, there is accommodation for survivors, which is outfitted similarly to the outfit normally given on life boats and escape capsules. With an internal shell diameter of 3 m, about fourteen to sixteen survivors could be accommodated.

The principal outfit of the accommodation consists of a foundation structure 19 and inner 20 and outer 21 rings of seats thereon. The following items are placed inside the foundation structure 19: electric batteries 22 with necessary installation, sewage tank 23 and fresh water tanks 24.

The inner 20 and outer 21 rings of seats are made of glass reinforced polyester sheathing with seats moulded to fit the survivors. Supports 25 fixing the survivors in place are fitted to the pressure shell 1. One of the seats in the inner row 20 is a sanitary appliance 26 connected to the sewage tank 23. In order to secure good fitting of individual seats to anthropometric characteristics of each of the survivors, pneumatic pillows 27 with adjustable inflation are provided.

A maneuvering console 29 is also fitted in the accommodation, which contains a radio station and underwater and wire telephones. The transmitter for the hydroacoustic signals of the underwater telephone, a signalling buoy, a radar reflector, position and flashable lights, and a telescopic mast for a radio antenna and the radar reflector are outside the accommodation.

Between the outside casing 2 and pressure hull 1, five elastic circumferential tanks 28 (only one shown) are fitted for additional buoyancy.

Figure 2:
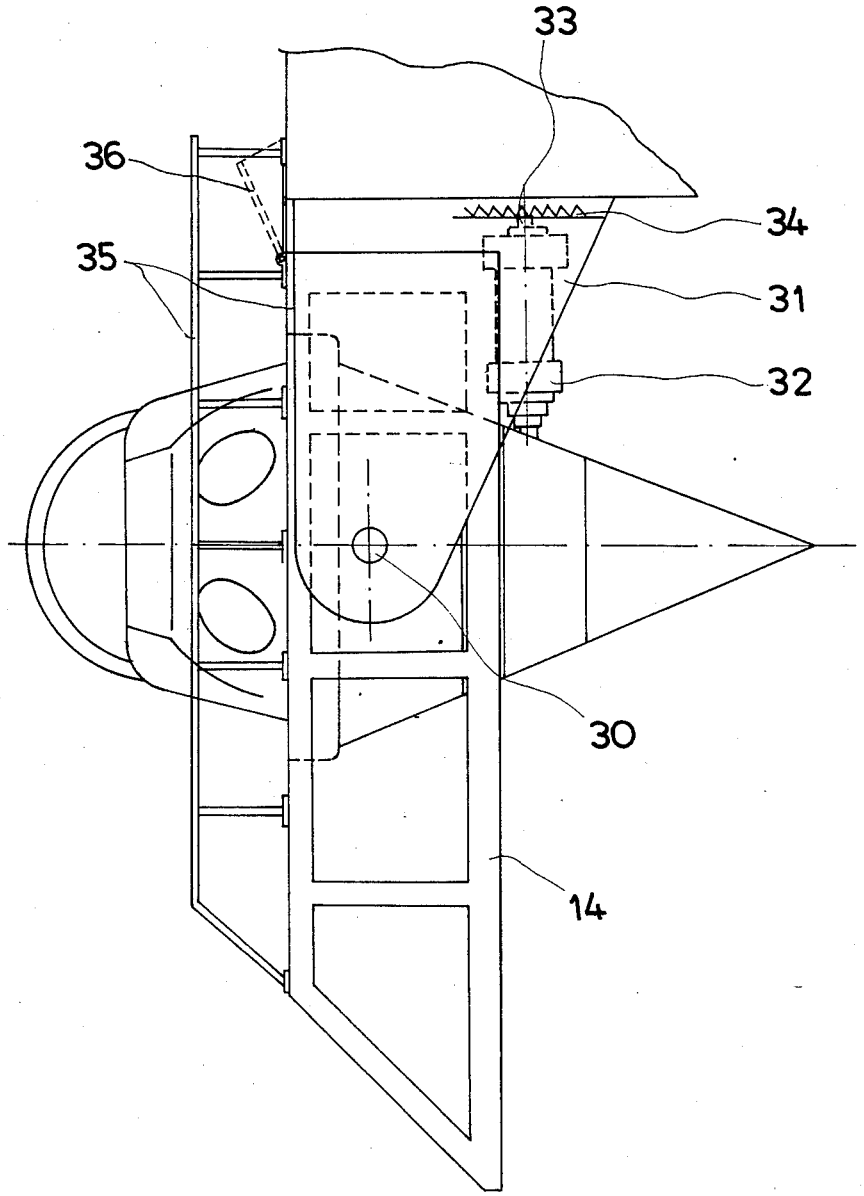
FIG. 2 shows a side elevation of the device and a catapult therefor.

As shown in FIG. 2 for one side of the catapult 15, the catapult for throwing the device a considerable distance has the tilting frame 16 supported pivotally on a bolt 30 of an outrigger 31 from the offshore structure OS. In the lower part of the tilting frame 16 is a launching jack 32 having a blocking bolt 33 at one end at the offshore structure OS and engaging the ballast 7 of the casing 2 at the opposite end. At the start of launching jack action, the blocking bolt extends back and enters any cut-out of a ratchet 34 on the offshore structure OS. This prevents the tilting frame 16 from tilting during launch of the device by further pneumatic or pirotechnic extension of the launching jack in a known manner, as a catapult, which, obviously slides the device along its guiding slots 17 on the tilting frame 16 to launch the device off the leftward end of the tilting frame 16 as shown in FIG. 2. On the upper part of the tilting frame 16, a grating (not shown) with a railing 35 (not shown in FIG. 1) is arranged to provide an easy path to the device from the deck of the offshore structure OS via a gangway 36.

Figure 3:
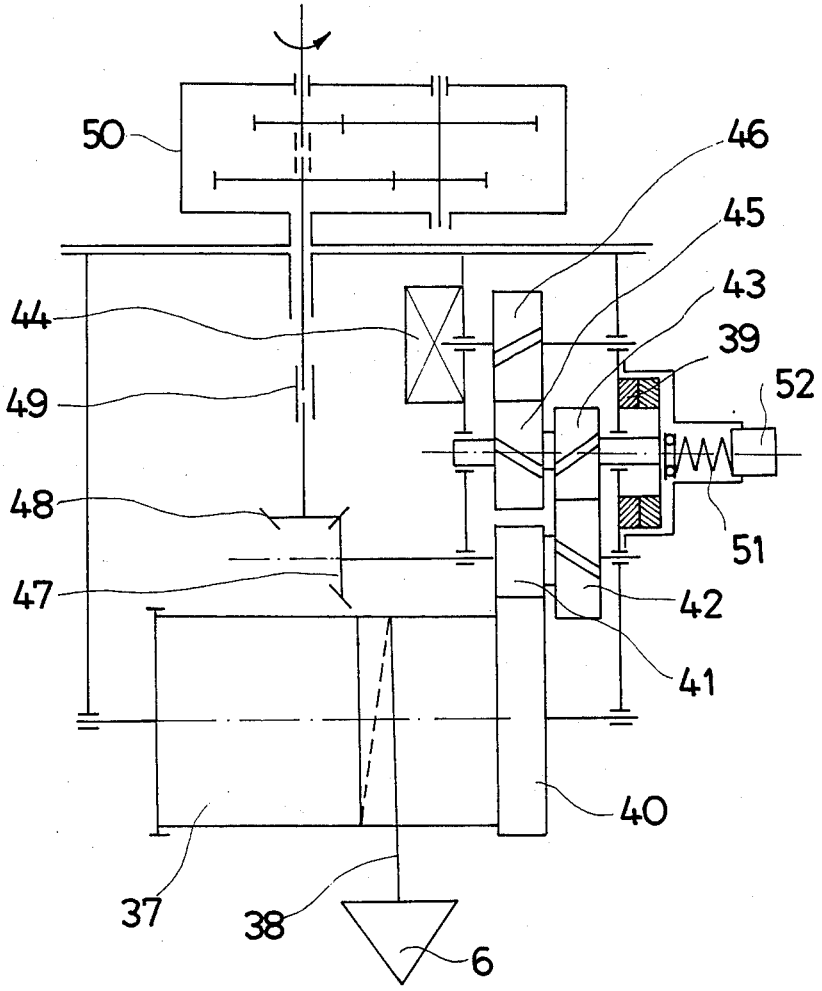
FIG. 3 shows a schematic of a windlass of the device in longitudinal section.

As shown in FIG. 3, the windlass 5 for automatic control of the tension in the anchor rope 38 has a rotatable drum 37 for the anchor rope 38 connected with a friction disk brake 39 through gear wheels 40, 41 and gear wheels 42, 43 having epicyclic teeth and, therefrom, with hydraulic brake 44 through further gear wheels 45, 46 also having epicyclic teeth. The gear wheels 42 and 43 can be relatively moved axially, whereby, as obvious from FIG. 3, they disengage, and rope drum 37 then can be driven from the cabin inside shell 1 through the gear wheels 40 and 41, bevel gear wheels 47 and 48, a clutch 49 and a reduction gear box 50 of hand drive (not shown) in the cabin on the other side of the pressure shell 1. The friction disc brake 39 is provided with a loading spring 51 held by a hydraulic depth corrector 52, which can move to release the loading of the loading spring and, thereby the friction brake.

Figure 4:
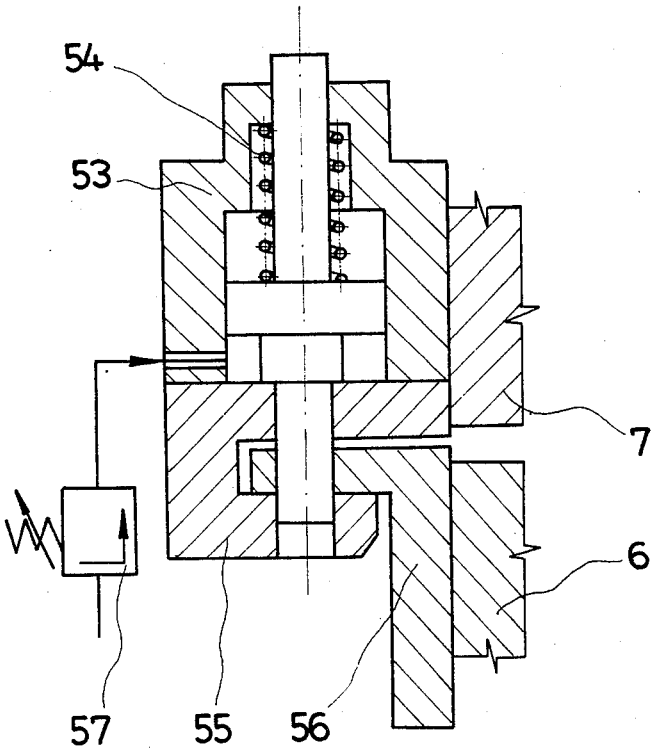
FIG. 4 shows an anchor grip of the device in longitudinal section.

As shown in FIG. 4, the anchor holder 9 has a hydraulic jack 53 fastened to the ballast 7 with a spring 54 urging its piston 53a into a holder 55 on its lower part and an anchor hook 56, which is held in the holder 55 by the piston until a special steering valve 57 is activated to provide sufficient pressure to push the piston against the spring and from the anchor hook.

The catapult 15 is placed in such a position on the offshore structure as to assure a safe launching of the device, penetrating the water surface at a sufficient distance from the structure. In case of danger to the lives of a crew on board the offshore structure and the necessity of abandoning it, the manholes 11 are opened for the survivors to enter the accommodation inside the spherical pressure shell 1 and take the seats in inner 20 and outer 21 rings of seats. The survivors fasten safety belts or use rigid supports 25. When the supports 25 are used, exact fitting is secured by pneumatic pillows 27 with adjustable inflation. The manholes 11 are closed with manhole covers 12 when the exact number of survivors have entered. After closing the manholes 11, a switch on manuevering console 29 is operated for activating a pirotechnical charge in the launching jack 32. The jack 32 then gives horizontal speed to the life saving device with the survivors therein as shown by the arrow in FIG. 2, moving it along the guiding frame 16 of the catapult 15, such that it penetrates the water surface at a required distance from the offshore structure.

After so launching the life saving device from the catapult 15, it submerges to a depth of 20 m. The valve 57 then causes release of the anchor holder 9 automatically, i.e. the valve 57 is depth activated and the anchor 6, thus freed from the ballast 7, then falls faster than the life saving device. The connection of the anchor 6 to the life saving device with the windlass 5 having the automatic, brake control of the force in the anchor rope causes, however, further submergence of the device, but at a slower rate than the anchor. Sufficient release of the brake forces to stop submergence of the device takes place at a maximum depth of 60 m, i.e. the hydraulic depth corrector 52 is responsible to the pressure thereat. The anchor 6 can still continue to submerge, however. When the anchor has bottomed, the life saving device becomes permanently anchored. The depth of submergence of the device is then regulated by the hand-drive gearing 50 in the pressure-shell accommodation. Bringing the device to the surface is also possible by disengaging the friction disc brake 39 with the hydraulic depth corrector 52, which is controlled pneumatically from inside the pressure-shell cabin too.

After stopping at the maximum desired depth, the air regenerating installation is switched on. Other physiological needs of the survivors are satisfied with food stored underneath the seats 20 and 21, the sanitary facility 26 connected with sewage tank 23 and fresh water from its tank 24. The air regenerating and lighting installations as well as communication equipment are supplied from the battery 22.

When a decision to surface is reached the tanks of additional buoyancy 28 are filled with gas and the anchor 6, ballast 7 and windlass 5 are jettisoned. After surfacing the device can be lifted, with the survivors, by the lifting frame 14.

The survivors can then leave the cabin, after opening a manhole cover 12 in the top part 3 of the pressure shell 1.

We claim:

1. A free fall, submersible life saving device for an offshore structure, the device comprising:

a spherical pressure-shell capsule for survivors, the pressure shell having at least one manhole with a closing cover in an upper part and glands for cables, piping and a windlass mechanical drive in a lower part, an outer casing about the pressure-shell capsule, the outer casing having a lower part;

a windlass with an anchor rope in the lower part of the casing, the windlass having the windlass mechanical drive through one of the glands into the pressure shell and automatic control means for controlling the force in the anchor rope;

a ballast and mechanical-grip means for detachably connecting the ballast to the lower part of the casing; and an anchor connected to the anchor rope and holder means for detachably fastening the anchor to the ballast.

2. The device of claim 1, and further comprising a catapult for fixing to an offshore structure and catapulting the pressure-shell capsule, outer casing, windlass, ballast and anchor therefrom with a horizontal speed.

3. The device of claim 2, and further comprising elastic pads between the pressure-shell capsule and outer casing.

4. The device of claim 3, and further comprising elastic tanks on the outer casing for additional buoyancy.

5. The device of claim 4, wherein the catapult comprises a tilting frame for slidably holding the ballast, outrigger means for pivotably mounting the tilting frame on the offshore structure, a ratchet having cutouts for connection to the offshore structure, and a launching jack on the tilting frame for catalpulting the device, the launching jack engaging the device at one end and having a blocking bolt at the opposite end for movement into any cut out of the ratchet to prevent pivoting of the tilting frame on the outrigger during the catapulting.

6. The device of claim 5, and further comprising: a foundation structure inside the pressure-shell capsule; electric batteries with installation means therefor, a sanitary installation, sewage tank, fresh water tanks, inner and outer rings of seats and a manuevering console having a radio station and underwater and wire telephones on the foundation; and a radio antenna, a transmitter for hydroacoustic signals, a signalling buoy, a radar reflector, position and flashable lights, and a telescopic mast for the radio antenna and radar reflector on the outside of the pressure shell.

7. The device of claim 5, wherein the windlass comprises a rotatable rope drum for the anchor rope and a gear connected to the rope drum for rotation therewith, the windlass mechanical drive comprises a clutch and gears clutched thereby for rotatably engaging the gear connected to the rope drum, and the automatic control means comprises an hydraulic brake and a controllable friction disc brake for rotatably engaging the gear connected to the rope drum.

8. The device of claim 7, wherein the controllable friction disc brake comprises a friction disc brake, a loading spring for spring loading the friction disc brake, and an hydraulic depth corrector means for holding the loading spring and moving to release the load of the loading spring in response to the depth beneath the surface of water thereof.

9. The device of claim 8, wherein the anchor has a hook, and wherein the holder means comprises an hydraulic jack fastened to the ballast and having a holder on a lower part for receiving the anchor hook, a piston, a spring urging the piston into the holder and anchor hook, and a steering valve for providing sufficient pressure to push the piston against the spring and from the anchor hook.

10. The device of claim 2, wherein the catapult comprises a tilting frame for slidably holding the ballast, outrigger means for pivotably mounting the tilting frame on the offshore structure, a ratchet having cutouts for connection to the offshore structure, and a launching jack on the tilting frame for catapulting the device, the launching jack engaging the device at one end and having a blocking bolt at the opposite end for movement into any cut out of the ratchet to prevent pivoting of the tilting frame on the outrigger during the catapulting.

11. The device of claim 1, and further comprising elastic pads between the pressure-shell capsule and outer casing.

12. The device of claim 1, and further comprising elastic tanks on the outer casing for additional buoyancy.

13. The device of claim 1, wherein the windlass comprises a rotatable rope drum for the anchor rope and a gear connected to the rope drum for rotation therewith, the windlass mechanical drive comprises a clutch and gears clutched thereby for rotatably engaging the gear connected to the rope drum, and the automatic control means comprises an hydraulic brake and a controllable friction disc brake for rotatably engaging the gear connected to the rope drum.

14. The device of claim 13, wherein the controllable friction disc brake comprises a friction disc brake, a loading spring for spring loading the friction disc brake, and an hydraulic depth corrector means for holding the loading spring and moving to release the load of the loading spring in response to the depth beneath the surface of water thereof.

15. The device of claim 13, wherein the anchor has a hook, and wherein the holder means comprises an hydraulic jack fastened to the ballast and having a holder on a lower part for receiving the anchor hook, a piston, a spring urging the piston into the holder and anchor hook, and a steering valve for providing sufficient pressure to push the piston against the spring and from the anchor hook.

16. The device of claim 1, wherein the anchor has a hook, and wherein the holder means comprises an hydraulic jack fastened to the ballast and having a holder on a lower part for receiving the anchor hook, a piston, a spring urging the piston into the holder and anchor hook, and a steering valve for providing sufficient pressure to push the piston against the spring and from the anchor hook.

* * * * *